US010537223B2

(12) United States Patent
Shin

(10) Patent No.: US 10,537,223 B2
(45) Date of Patent: Jan. 21, 2020

(54) MOP TOOL

(71) Applicant: Manchul Shin, Woodcliff Lake, NJ (US)

(72) Inventor: Manchul Shin, Woodcliff Lake, NJ (US)

( * ) Notice: Subject to any disclaimer, the term of this patent is extended or adjusted under 35 U.S.C. 154(b) by 238 days.

(21) Appl. No.: 15/408,949

(22) Filed: Jan. 18, 2017

(65) Prior Publication Data

US 2017/0258287 A1 Sep. 14, 2017

(30) Foreign Application Priority Data

Mar. 14, 2016 (KR) ..... 10-2016-0030170

(51) Int. Cl.

| | |
|---|---|
| ***A47L 13/254*** | (2006.01) |
| ***A47L 13/24*** | (2006.01) |
| ***A47L 13/44*** | (2006.01) |
| ***B25G 3/12*** | (2006.01) |
| ***B25G 3/38*** | (2006.01) |

(52) U.S. Cl.

CPC ..... *A47L 13/24* (2013.01); *A47L 13/44* (2013.01); *B25G 3/12* (2013.01); *B25G 3/38* (2013.01); *A47L 13/254* (2013.01)

(58) Field of Classification Search

CPC ..... A47L 13/20; A47L 13/24; A47L 13/254; A47L 13/256

USPC ..... 15/147.1, 228

See application file for complete search history.

(56) References Cited

U.S. PATENT DOCUMENTS

| | | | | | |
|---|---|---|---|---|---|
| 226,551 | A * | 4/1880 | Randolph | F16B 7/0486 | 403/3 |
| 919,610 | A * | 4/1909 | Maeder | A46B 5/0075 | 15/144.1 |
| 3,239,866 | A * | 3/1966 | Czerniawski | A47L 13/255 | 15/146 |
| 3,321,791 | A * | 5/1967 | Olsen | A47L 13/24 | 15/153 |
| 4,194,852 | A * | 3/1980 | Cupp | B05C 17/00 | 15/145 |
| 4,658,461 | A * | 4/1987 | Roe | B05C 17/00 | 15/144.1 |
| 5,937,471 | A * | 8/1999 | Liao | A46B 5/0054 | 15/111 |
| 6,481,042 | B1 * | 11/2002 | Hsieh | A47L 13/254 | 15/147.1 |

(Continued)

FOREIGN PATENT DOCUMENTS

| | | |
|---|---|---|
| JP | 2004049619 | 2/2004 |
| JP | 2005287698 | 10/2005 |

(Continued)

*Primary Examiner* — Michael D Jennings

(74) *Attorney, Agent, or Firm* — Cantor Colburn LLP

(57) ABSTRACT

A mop tool is provided. The mop tool includes: an elongated stick; a cleaning head which includes a head body that has a coupling portion rotatably coupled to one end of the stick, and a gap portion that extends from the coupling portion of the head body toward at least one side of the head body; and a rotation control element which is installed on the stick so as to be movable along the stick. The rotation control element includes a locking member which is releasably coupled to at least a part of the head body which adjoins the gap portion, and restricts a relative rotation between the cleaning head and the stick.

17 Claims, 10 Drawing Sheets

(56) References Cited

U.S. PATENT DOCUMENTS

| | | | | |
|---|---|---|---|---|
| 6,546,584 | B2 * | 4/2003 | Hobden | B05C 17/00 15/144.1 |
| 8,286,294 | B2 * | 10/2012 | Cassar | A47L 13/24 15/144.1 |
| 9,179,815 | B2 * | 11/2015 | Davidshofer | A47L 13/254 |
| 2003/0009839 | A1 * | 1/2003 | Streutker | A47L 13/24 15/228 |
| 2013/0019428 | A1 * | 1/2013 | Johansson | A47L 13/254 15/228 |
| 2017/0144197 | A1 * | 5/2017 | Byrd | B08B 1/002 |

FOREIGN PATENT DOCUMENTS

| | | |
|---|---|---|
| JP | 4395715 | 1/2010 |
| JP | 4676755 | 4/2011 |
| JP | 03173533 | 2/2012 |
| KR | 200336397 | 12/2003 |
| KR | 100439952 | 7/2004 |
| KR | 101455037 | 10/2014 |
| KR | 20160017965 | 2/2016 |

* cited by examiner

MOP TOOL

CROSS-REFERENCE TO RELATED APPLICATIONS

This application is based on and claims priority from Korean Patent Application No. 10-2016-0030170, filed on Mar. 14, 2016 with the Korean Intellectual Property Office, the disclosure of which is incorporated herein in its entirety by reference.

TECHNICAL FIELD

The present disclosure relates to a mop tool to which a mop is detachably attached.

BACKGROUND

In general, a mop tool to which a mop is detachably attached is used to clean floors in various types of buildings and various locations. With the mop tool, a user can easily remove foreign substances such as dust and contaminants on a floor without bending at his/her waist, as compared to the case in which the user cleans the floor merely using a mop. In addition, the mop tool which enables the user to more directly wipe foreign substances off the floor as compared to a vacuum cleaner is quite inexpensive to purchase and maintain as compared to the vacuum cleaner, and as a result, the mop tool is widely used together with, or separately from, the vacuum cleaner. See, for example, Korean Patent Publication Nos. 10-0439952 and 10-1455037.

SUMMARY

An exemplary embodiment of the present disclosure provides a mop tool. The mop tool includes: an elongated stick; a cleaning head which includes a head body that has a coupling portion rotatably coupled to one end of the stick, and a gap portion that extends from the coupling portion of the head body toward at least one side of the head body; and a rotation control element which is installed so as to be movable along the stick. The rotation control element includes a locking member and the locking member is configured to releasably couple with at least a part of the head body that adjoins the gap portion so as to restrict a relative rotation between the cleaning head and the stick.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
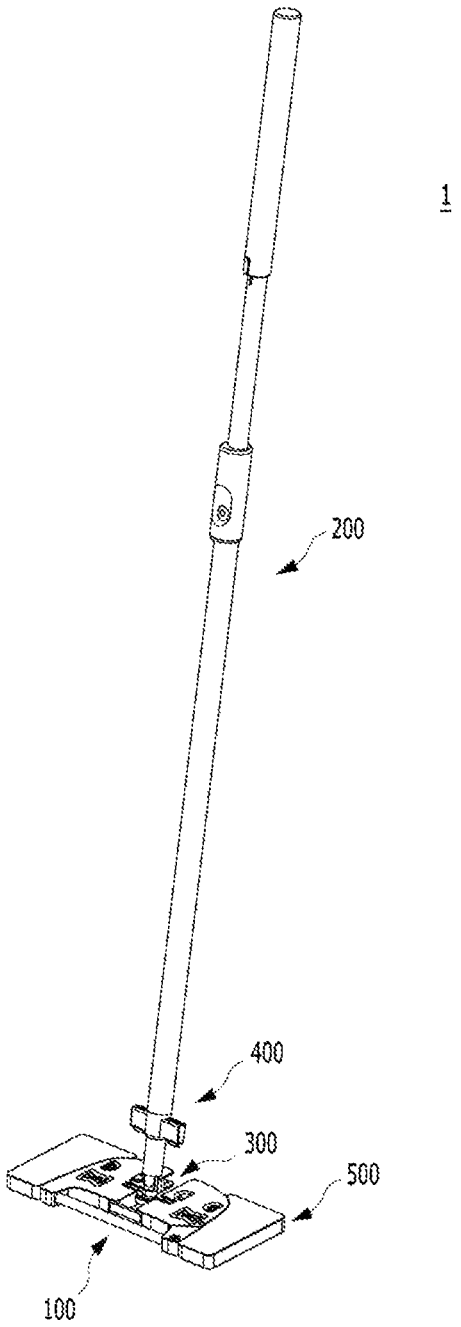
FIG. 1 is a perspective view schematically illustrating a mop tool according to an exemplary embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

In general, different kinds of mops are selected and used based on shapes of mops to be used. For example, because various kinds of mops such as washable and reusable mops having tubular plies, disposable non-woven fabric mops, or superfine fiber mops need to be coupled to a mop tool suitable for the mops, the user suffers from the inconvenience of necessarily purchasing the mop tool in order to use a desired type of mop. In addition, in a case in which a large sized mop is fixed to the mop tool, there is a problem in that it is difficult to uniformly distribute force to the entire mop when using the mop tool, and as a result, it is impossible to efficiently perform cleaning. Furthermore, there is a need for a mop tool that can be easily handled when washing a mop coupled to the mop tool.

The present disclosure has been made in consideration of these problems.

An exemplary embodiment of the present disclosure provides a mop tool. The mop tool includes: an elongated stick; a cleaning head including a head body that has a coupling portion rotatably coupled to one end of the stick, and a gap portion that extends from the coupling portion of the head body toward at least one side of the head body; and a rotation control element installed to be movable along the stick. The rotation control element includes a locking member and the locking member is configured to releasably couple with at least a part of the head body which adjoins the gap portion so as to restrict a relative rotation between the cleaning head and the stick.

The gap portion may extend to penetrate at least one side of the head body, and the stick may be configured to rotate by passing through the gap portion. The head body may include a side locking groove extending into the head body from the side of the head body which the gap portion penetrates, and the locking member may be releasably inserted into the side locking groove. The coupling portion of the head body includes an angled locking groove into which the locking member is releasably inserted, and when the locking member is inserted into the angled locking groove, the stick forms a predetermined angle with the cleaning head.

The center of gravity of the cleaning head is spaced apart from the coupling portion of the head body in an opposite direction to the side locking groove on an axis of the gap portion in a direction in which the gap portion extends.

The cleaning head includes a hanging bar located at an opposite side of the head body to the side locking groove so as to hang a mop, and the hanging bar is spaced apart from the head body in a direction in which the gap portion extends. The head body includes a first head member and a second head member, and the gap portion is positioned between the first head member and the second head member. One end of the hanging bar is coupled to the first head member, and the other end of the hanging bar is releasably coupled to a bar fixing member rotatably coupled to the second head member. The bar fixing member includes a hollow portion configured to receive the other end of the hanging bar, and a control rod extending transversally to the hollow portion and being capable of engaging with the other end of the hanging bar.

The rotation control element further includes an elongated accommodating member having an internal space which the stick penetrates, and the locking member includes a wing portion which extends from one end of the accommodating member in a radial direction of the accommodating member. The accommodating member includes a positioning hole which penetrates the accommodating member in the radial direction of the accommodating member. The stick includes at least one push button configured to move in a radial direction of the stick to be inserted into the positioning hole so as to prevent a relative movement between the rotation control element and the stick. An elastic member is mounted at one end of the push button so as to cause the push button to elastically protrude from or be inserted into an outer surface of the stick.

The mop tool may further include a rotation coupling element configured to couple the stick to the coupling portion of the head body. The rotation coupling element includes a shaft which is coupled to the coupling portion of the head body and has a first axis, and a connector which connects the stick to the shaft. The connector includes a curvature portion which is coupled to the shaft so as to be rotatable about the first axis, a rotating portion which is coupled to the curvature portion so as to be rotatable about a second axis perpendicular to the first axis, and a hole which has a third axis perpendicular to both of the first axis and the second axis and penetrates the rotating portion. One end of the stick is coupled to the hole so as to be rotatable about the third axis.

The mop tool may further include an extension element which is coupled to at least one side of the head body. The extension element is configured to move toward the head body or away from the head body. The extension element includes at least one extension block. The extension block includes a block body and a guide bar that extends outward from the block body. The guide bar is configured to be inserted into the head body. The head body includes an extension passageway into which the guide bar is inserted, and a cross-sectional shape of the guide bar is configured to prevent a relative rotation between the head body and the guide bar inserted into the head body. The guide bar includes a length adjusting member which is elastically movable in a thickness direction of the guide bar, and the length adjusting member is configured to be inserted into a plurality of length adjusting grooves provided in the head body.

Any one or both of the cleaning head and the extension element includes or include a mop coupling element to which the mop is detachably coupled. The mop coupling element includes a plurality of couplers configured to hold the mop. The plurality of couplers may have different coupling structures from each other. At least a part of the head body may be made of metal, synthetic resin, rubber, fibers, or a combination thereof.

Hereinafter, exemplary embodiments of the present disclosure will be described with reference to the accompanying drawings.

FIG. 1 is a perspective view schematically illustrating an exemplary embodiment of a mop tool 1 according to the present disclosure. As illustrated in FIG. 1, the mop tool 1 according to the exemplary embodiment includes an elongated stick 200, a cleaning head 100 rotatably coupled to one end of the stick 200, and a rotation control element 400 installed on the stick 200 to be movable along the stick 200. In addition, the mop tool 1 further includes an extension element 500 coupled to at least one side of the cleaning head 100. The extension element 500 may be moved toward the cleaning head 100 or away from the cleaning head 100.

Figure 2A:
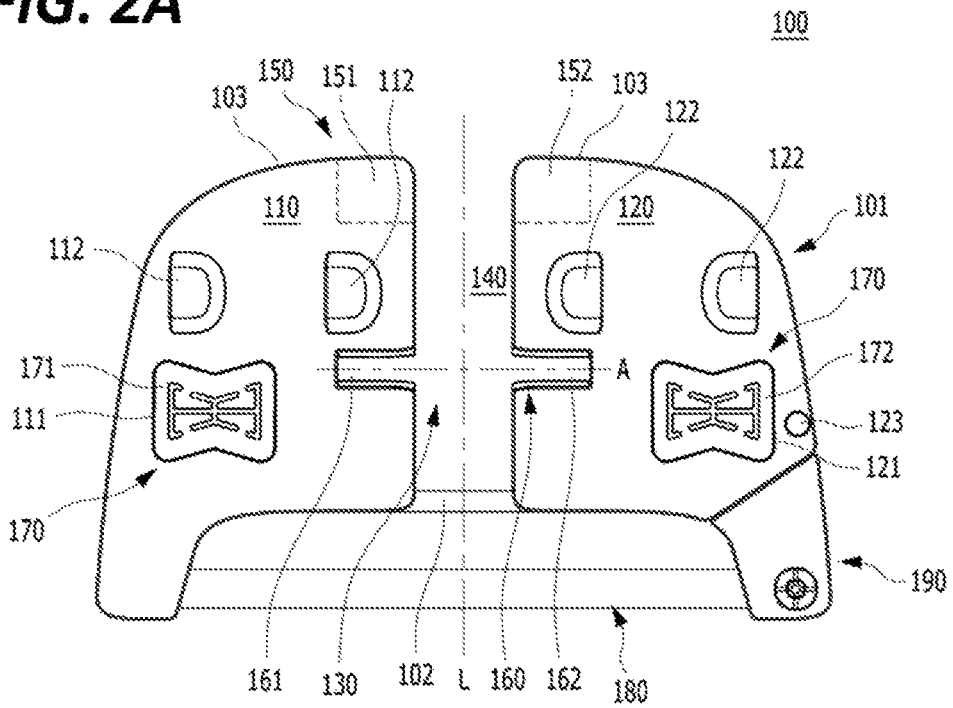
FIG. 2A is a top view of a cleaning head illustrated in FIG. 1.

FIG. 2A is a top view of the cleaning head 100 illustrated in FIG. 1. The cleaning head 100 includes a head body 101 which has a coupling portion 130 rotatably coupled to one end of the stick 200, and a gap portion 140 which extends toward at least one side of the head body 101 from the coupling portion 130 of the head body 101.

The head body 101 includes a first head member 110 and a second head member 120, and the gap portion 140 is positioned between the first head member 110 and the second head member 120. In FIG. 2A, the gap portion 140 extends to both sides of the coupling portion 130, and the first head member 110 and the second head member 120 are separated and spaced apart from each other by the gap portion 140. In another exemplary embodiment, the first head member 110 and the second head member 120 may be integrally formed, and the gap portion 140 may be formed in a part of a region in which the first head member 110 and the second head member 120 face each other.

The first head member 110 and the second head member 120 have the same or corresponding shape, and are disposed to be symmetric to each other with respect to the gap portion 140, and connected to each other through a link 102 disposed at one side of the head body 101. In FIG. 2A, the head body 101 generally has a trapezoidal shape, and each of the first head member 110 and the second head member 120 has the shape corresponding to a half of the trapezoidal shape. At least a part of the head body 101 may be made of a material that is not corroded by water or a liquid for cleaning. At least a part of the head body 101 may be made of metal, synthetic resin, rubber, fibers, or a combination thereof. At last a part of the head body 101 may include aluminum, stainless steel, carbon fibers, aramid fibers, graphite, silicon, or plastic. In addition, at least a part of the head body 101 may be made of an abrasion-resistance material so as not to be damaged due to friction with a ground surface or a mop in use. At least a part of the head body 101 may be subjected to a surface treatment such as anodizing, or may include an anti-corrosive film or coating so as not to be corroded by water or a liquid for cleaning.

The link 102 is disposed across the gap portion 140 such that both ends of the link 102 are coupled to the first head member 110 and the second head member 120, respectively. For example, the link 102 may be coupled to the head members 110 and 120 by screw connection, interference fit, welding, clamping, bonding, engagement, or a combination thereof. In addition, the link 102 may be rotatably coupled to at least one of the head members 110 and 120. Furthermore, the link 102 may be releasably coupled to the head members 110 and 120, and a plurality of links 102 may be provided.

The gap portion 140 extends to penetrate a first side 103 positioned at an upper side of the head body 101 in FIG. 2A, and the stick 200 can rotate to pass through the gap portion 140. The head body 101 includes a side locking groove 150 which extends from the first side 103 of the head body 101, which the gap portion 140 penetrates, to the interior of the head body 101. The side locking groove 150 includes a first locking groove 151 provided in the first head member 110, and a second locking groove 152 provided in the second head member 120. A locking member 420 of the rotation control element 400 can be inserted into the side locking groove 150 so as to restrict the relative rotation between the cleaning head 100 and the stick 200. At least a part of the side locking groove 150 may include an inclined portion that is inclined with respect to a direction perpendicular to the first side 103 of the head body 101 in order to allow the locking member 420 to be easily inserted. The rotation control element 400 and the locking member 420 will be described in detail below with reference to FIGS. 4A to 4D.

A rotation coupling element 300, which couples the stick 200 with the head body 101, is coupled to the coupling portion 130 of the head body 101. The coupling portion 130 of the head body 101 includes a part of the first head member 110 and a part of the second head member 120. The rotation coupling element 300 includes a shaft 310 having a first axis A and both ends of the shaft are coupled to the parts of the first and second head members 110 and 120, respectively. The cleaning head 100 can rotate about the first axis A with respect to the stick 200. The rotation coupling element 300 and the shaft 310 will be described in detail below with reference to FIG. 3.

The coupling portion 130 of the head body 101 includes an angle locking groove 160 into which the locking member 420 of the rotation control element 400 can be releasably inserted. When the locking member 420 is inserted into the angled locking groove 160, the stick 200 forms a predetermined angle with the cleaning head 100. For example, when the locking member 420 is inserted into the angled locking groove 160, the stick 200 may form an angle of 90° with the cleaning head 100, or may form any angle that allows a user to easily use the mop tool 1.

Figure 2B:
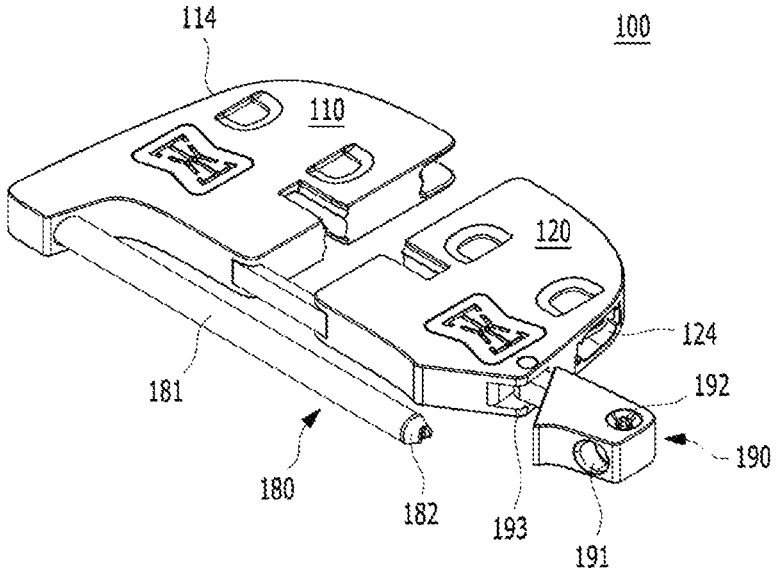
FIG. 2B is a perspective view illustrating a state in which a bar fixing member of the cleaning head illustrated in FIG. 2A has rotated counterclockwise.

In FIG. 2A, the angled locking groove 160 includes a third locking groove 161 which extends in the first head member 110 in a thickness direction of the first head member 110, and a fourth locking groove 162 which extends in the second head member 120 in a thickness direction of the second head member 120. In FIG. 2A, the angled locking groove 160 is formed to penetrate the top surface of the head body 101, and the rotation coupling element 300 coupled to the coupling portion 130 of the head body 101 is exposed to the outside through the angled locking groove 160. The third locking groove 161 and the fourth locking groove 162 may include inclined portions inclined toward the bottom surface of the head body 101 in order to allow the locking member 420 to be easily inserted through the top surface of the head body 101. Further, the third locking groove 161 and the fourth locking groove 162 may include inclined portions inclined toward the top surface of the head body 101 in order to allow the locking member 420 to be easily inserted through the bottom surface of the head body 101. In FIG. 2B, the third locking groove 161 and the fourth locking groove 162 are formed to be inclined toward central portions thereof, respectively.

The cleaning head 100 includes a mop coupling element 170 to which the mop is detachably coupled. The mop coupling element 170 includes at least one coupler, and the mop is held by the coupler. The coupler includes a hook-and-loop fastener such as Velcro®, a clamp, an adhesive, a groove, a screw, or a combination thereof. The mop coupling element 170 may include a plurality of couplers having different coupling structures from each other. The mop coupling element 170 may be provided on at least one of the top surface, the bottom surface, and a side surface of the cleaning head 100.

In FIG. 2A, the first head member 110 and the second head member 120 include a first coupling groove 111 and a second coupling groove 121, respectively, which extend in a thickness direction of the head body 101, and the mop coupling element 170 includes a first coupler 171 and a second coupler 172 which are inserted into the first coupling groove 111 and the second coupling groove 121, respectively. Each of the first and second coupling grooves 111 and 121 illustrated in FIG. 2A has a shape that widens from a center toward both sides thereof. In addition, each of the first coupler 171 and the second coupler 172 illustrated in FIG. 2A is configured to have a groove which holds at least a part of the mop and has a shape formed by two intersecting 'H' shaped openings. However, it will be appreciated that the coupling grooves 111 and 121, the couplers 171 and 172, and the grooves thereof may have various shapes as long as the coupling grooves 111 and 121, the couplers 171 and 172, and the grooves thereof can hold the mop. In addition, the couplers 171 and 172 may be formed to display a trademark or a company's name, or may have a shape that provides an aesthetic appearance. At least a part of the couplers 171 and 172 may be made of synthetic resin, rubber, fibers, silicon, or a combination thereof. At least a part of the couplers 171 and 172 may include carbon fibers, aramid fibers, silicon, or graphite. Furthermore, the couplers 171 and 172 may have a color different from a color of the head body 101 such that the couplers 171 and 172 can be clearly distinguished from the head body 101, or can provide an aesthetic appearance. For example, the head body 101 may be silver or white, and the couplers 171 and 172 may be black or grey. The first coupler 171 and the second coupler 172 may be different from each other in terms of at least one of a shape, a color, and a mop coupling structure.

The cleaning head 100 includes at least one extension passageway 114 or 124 into which the extension element 500 is inserted (see, e.g., FIG. 2B), and at least one length adjusting groove 112 or 122 which extends to be perpendicular to the extension passageway 114 or 124. In FIG. 2A, two length adjusting grooves 112 are disposed in the first head member 110, other two length adjusting grooves 122 are disposed in the second head member 120, and these length adjusting grooves 112 and 122 penetrate the top surface of the head body 101. A part of the extension element 500 inserted into the cleaning head 100 is exposed to the outside through the length adjusting groove 112 or 122.

The cleaning head 100 includes a hanging bar 180 for hanging the mop at the opposite side to the side locking groove 150, and the hanging bar 180 is spaced apart from the head body 101 in a direction in which the gap portion 140 extends. One end of the hanging bar 180 is coupled to the first head member 110. For example, the hanging bar 180 may be releasably coupled to the first head member 110. In addition, the hanging bar 180 may be coupled to the first head member 110 by screw connection, interference fit, welding, clamping, bonding, or a combination thereof. The hanging bar 180 may be formed integrally with the first head member 110. For example, the hanging bar 180 and the first head member 110 may be manufactured by injection molding or casting. The other end of the hanging bar 180 is coupled to a bar fixing member 190 that is rotatably coupled to the second head member 120. In FIG. 2A, the bar fixing member 190 is hinged to a hinge coupling portion 123 of the second head member 120.

FIG. 2B is a perspective view illustrating a state in which the bar fixing member 190 of the cleaning head 100 illustrated in FIG. 2A has rotated counterclockwise. In FIG. 2B, the hanging bar 180 has a cylindrical main body 181 and a truncated conical end portion 182. In another exemplary embodiment, the main body or the end portion of the hanging bar 180 may have a polygonal shape (e.g., a quadrangular or triangular shape) in cross-section. The bar fixing member 190 includes a hollow portion 191 which receives the end portion 182 of the hanging bar 180, and a control rod 192 which extends transversely to the hollow portion 191 to be engaged with the truncated conical end portion 182 of the hanging bar 180. In addition, the bar fixing member 190 includes a hinge portion 193 hinged to the hinge coupling portion 123 of the second head member 120.

Figure 2C:
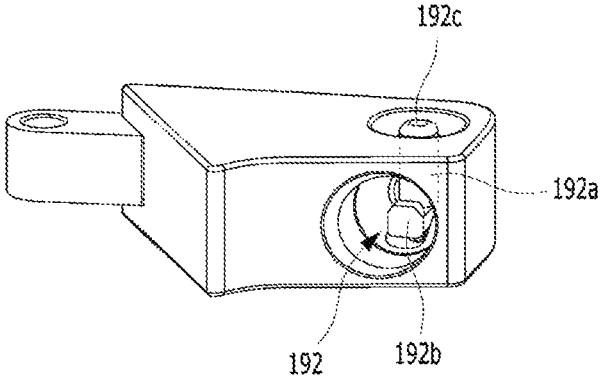
FIG. 2C is an enlarged perspective view of the bar fixing member illustrated in FIG. 2B.

FIG. 2C is an enlarged perspective view of the bar fixing member 190 in FIG. 2B. The control rod 192 includes a column 192*a* which extends transversely to the hollow portion 191, an engaging portion 192*b* which radially protrudes from the column 192*a* to be engaged with the hanging bar 180, and an operating portion 192*c* which is positioned at an end portion opposite to the engaging portion 192*b* and exposed to the outside.

The control rod 192 is configured to be elastically movable in a longitudinal direction of the column 192*a*. For example, an elastic member such as a spring may be coupled to one end of the column 192*a* so that when the user pushes the operating portion 192*c*, elastic force is applied in a direction opposite to the pushing direction.

At least a part of the engaging portion 192*b* of the control rod 192 is inserted into a radial groove (not illustrated) formed in a lower portion of the end portion 182 of the hanging bar 180 such that the engaging portion 192*b* is engaged with the end portion 182 of the hanging bar 180. In addition, an end surface of the end portion 182 of the hanging bar 180, which faces the control rod 192, is configured so that when the engaging portion 192*b* comes into contact with the end surface and is presses against the end surface, the engaging portion 192*b* is guided along the end surface toward the radial groove of the end portion 182 of the hanging bar 180. When the user rotates the bar fixing member 190 from the state illustrated in FIG. 2B toward the hanging bar 180, the engaging portion 192*b* comes into contact with the end portion 182 of the hanging bar 180, and the control rod 192 is moved downward as the engaging portion 192*b* moves along the end surface of the end portion 182. When the engaging portion 192*b* reaches the radial groove of the end portion 182, the control rod 192 is moved upward by elastic force such that the engaging portion 192*b* is inserted into the radial groove of the end portion 182. When the hanging bar 180 and the control rod 192 are engaged with each other, the bar fixing member 190 is prevented from rotating with respect to the second head member 120 and the hanging bar 180 is prevented from moving by external force that is applied to the mop and the hanging bar 180 when the mop is fastened to the hanging bar 180. When the operating portion 192*c* of the control rod 192 is pushed, the engaging portion 192*b* is withdrawn from the radial groove of the end portion 182 of the hanging bar 180, and as a result, the engaging portion 192*b* is disengaged from the end portion of the hanging bar 180. In this disengaged state, the user can freely rotate the bar fixing member 190.

The diameter of the hollow portion 191 may be equal to or greater than the diameter of the main body 181 of the hanging bar 180. In addition, the sizes and shapes of the hanging bar 180 and the hollow portion 191 may be determined so as to ensure excellent position alignment and coupling between the end portion 182 of the hanging bar 180 and the bar fixing member 190 when the bar fixing member 190 rotates clockwise from the state illustrated in FIG. 2B to the state illustrated in FIG. 2A.

When it is intended to fasten the mop to the hanging bar 180, the bar fixing member 190 is rotated with respect to the second head member 120 so that the end portion 182 of the hanging bar 180 is exposed as illustrated in FIG. 2B. The mop is fastened to the hanging bar 180 and the bar fixing member 190 is rotated to be coupled with the hanging bar 180 as illustrated in FIG. 2A. Consequently, it is possible to prevent the mop from escaping from the hanging bar 180.

The center of gravity of the cleaning head 100 is positioned on an axis L extending along the gap portion 140 and is spaced apart from the coupling portion 130 of the head body in an opposite direction to the side locking groove 150. The center of gravity of the cleaning head 100 may be controlled by adjusting a material or a shape of the cleaning head 100 or by mounting a weight on the cleaning head 100. In addition, the cleaning head 100 and the extension element 500 may be configured such that when the cleaning head 100 and the extension element 500 are assembled, the center of gravity of the assembly is positioned on the axis L extending along the gap portion 140 and is spaced apart from the coupling portion 130 of the head body in an opposite direction to the side locking groove 150.

In FIG. 2A, the center of gravity of the cleaning head is positioned on the axis L extending along the gap portion 140, and positioned at a point spaced apart from the first axis A toward the hanging bar 180. When the user holds the stick 200 and lifts up the mop tool 1 in a case in which the center of gravity is positioned as described above, the center of gravity of the cleaning head 100 spaced apart from the first axis A (i.e., the rotation axis of the cleaning head 100) and the weight of the cleaning head causes a rotational moment on the cleaning head 100 and the cleaning head 100 is rotated due to the rotational moment. As a result, the hanging bar 180 is directed toward the ground surface below the mop tool 1. In this state, the locking member 420 of the rotation control element 400 can be easily inserted into the side locking groove 150 of the cleaning head 100.

In another exemplary embodiment, the head body 101 includes one or more through holes that extend in a thickness direction of the head body 101. For example, in a state in which the mop is coupled to the bottom side of the cleaning head 100 and the locking member 420 is inserted into the angled locking groove 160, when the user immerses the mop in a washing liquid such as water and then moves the stick 200 upward and downward or shakes the stick 200, the washing liquid can pass through the mop and then move through the through holes of the head body 101. As a result, dust or other contaminants attached to the mop can be easily separated from the mop. Therefore, in a case in which the mop tool 1 is used, it is not necessary to separate the mop from the cleaning head 100 in order to wash the mop. In addition, the user can easily wash and reuse the mop without using a disposable mop, and as a result, cleaning efficiency can be improved, and resources and costs can be saved.

Figure 3:
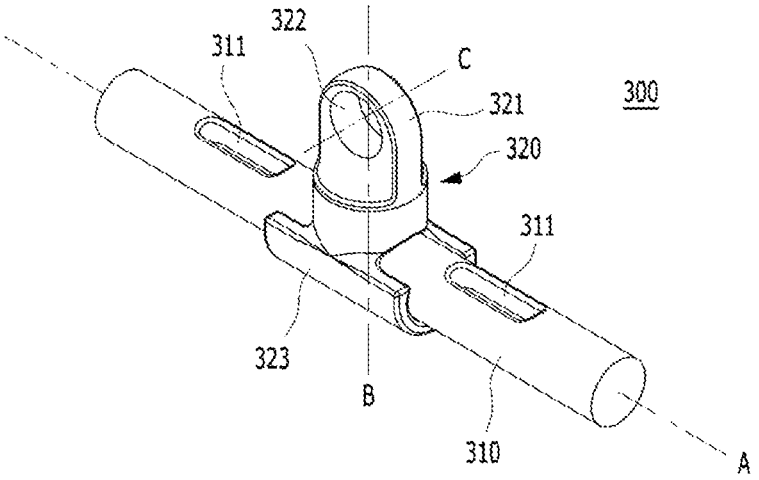
FIG. 3 is a perspective view schematically illustrating a rotation coupling element of the mop tool in FIG. 1.

FIG. 3 is a perspective view schematically illustrating the rotation coupling element 300 of the mop tool 1 in FIG. 1. The rotation coupling element 300 couples the stick 200 with the coupling portion 130 of the head body 101 in such a manner in which the stick 200 and the coupling portion 130 of the head body 101 are rotatable relative to each other. The rotation coupling element 300 includes the shaft 310 which is coupled to the coupling portion 130 of the head body 101 and has the first axis A, and a connector 320 which connects the stick 200 and the shaft 310 to each other.

Both end portions of the shaft 310 are coupled to the coupling portion 130 of the head body 10. One end of the shaft 310 extends into the first head member 110, and is inserted into a groove of the first head member 110 which has an axis identical to the first axis A of the shaft 310. The other end of the shaft 310 extends into the second head member 120, and is inserted into a groove of the second head member 120 which has an axis identical to the first axis A of the shaft 310. At least one end portion of the shaft 310 may be configured to elastically move along the first axis A of the shaft 310, and as a result, the rotation coupling element 300, which is in a state of being separated from the coupling portion 130 of the head body 101, may be easily coupled to the coupling portion 130 of the head body 101. The shaft 310 includes concave portions 311 recessed radially inward from an outer surface of the shaft. Extension portions 422 of the locking member 420, which will be described below, can be inserted into the concave portions 311.

The connector 320 includes a curvature portion 323 which is disposed around the shaft 310, a rotating portion 321 which extends outward from the curvature portion 323 in a radial direction of the shaft 310, and a hole 322 which penetrates the rotating portion 321 in a thickness direction of the rotating portion 321.

The curvature portion 323 can rotate with respect to the shaft 310 about the first axis A of the shaft 310. In another exemplary embodiment, the curvature portion 323 is fixed to the shaft 310, and the shaft 310 can rotate with respect to the cleaning head 100 about the first axis A. Both of the shaft 310 and the curvature portion 323 may be configured to be rotatable. The rotating portion 321 can rotate about a second axis B perpendicular to the first axis A of the shaft 310. The hole 322 has a third axis C perpendicular to both of the first axis A and the second axis B. The end portion of the stick 200 is coupled to the hole 322 so as to be rotatable about the third axis C. The stick 200 is coupled to the rotation coupling element 300, and is rotatable with respect to the cleaning head 100 about the three axes including the first axis A, the second axis B, and the third axis C which are perpendicular to one another. As a result, the free rotational movement of the stick 200 can be ensured by the rotation coupling element 300.

In another exemplary embodiment, the rotation coupling element 300 includes a ball-socket coupling portion. For example, the shaft 310 and the stick 200 may be connected by means of the ball-socket coupling portion.

Figure 4A:
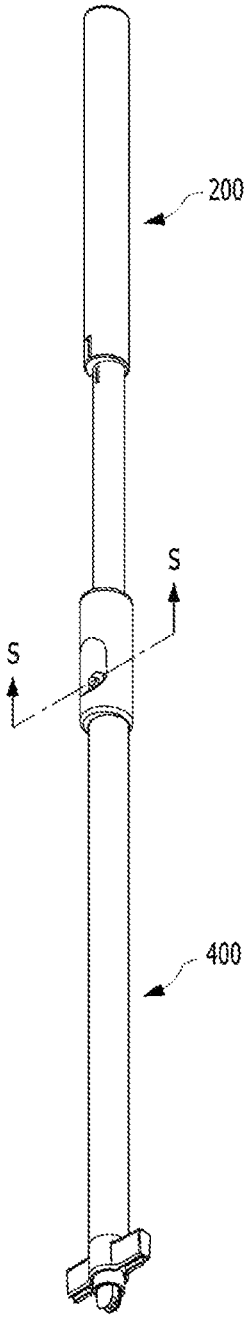
FIG. 4A is a perspective view illustrating a state in which a rotation control element is coupled to a stick of the mop tool in FIG. 1.
Figure 4B:
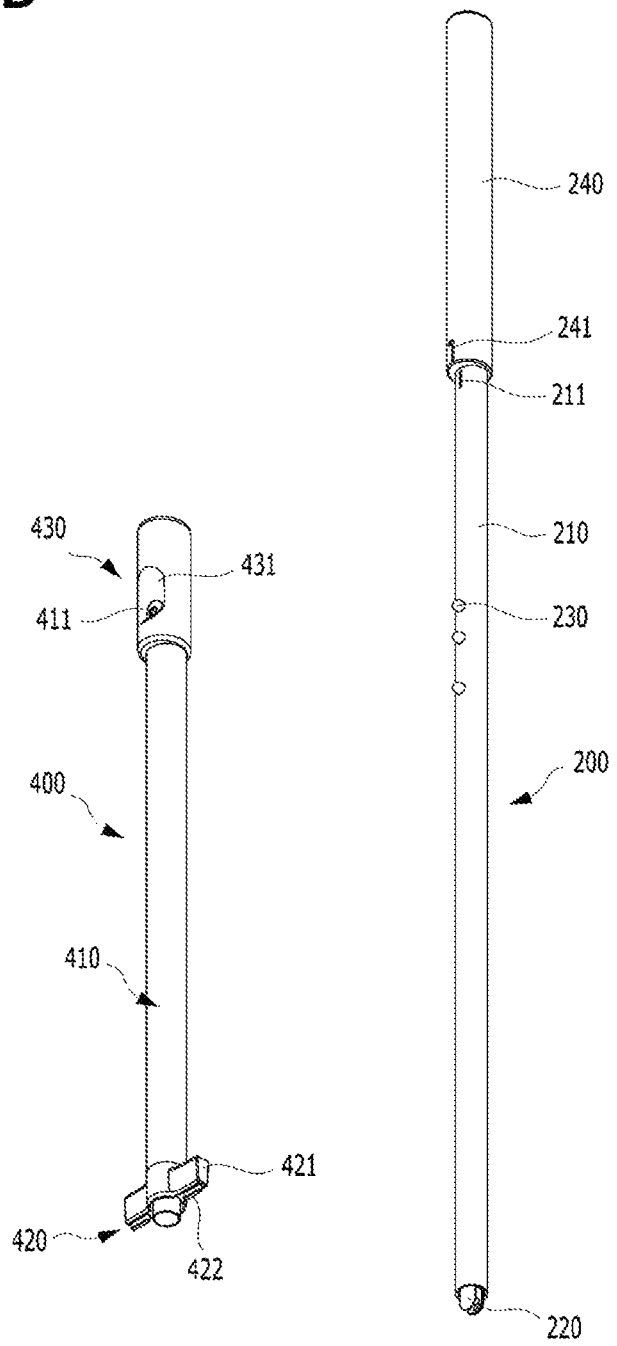
FIG. 4B is an exploded perspective view illustrating a state in which the stick and the rotation control element illustrated in FIG. 4A are separated from each other.

FIG. 4A is a perspective view illustrating a state in which the rotation control element 400 is coupled to the stick 200 of the mop tool 1 in FIG. 1, and FIG. 4B is an exploded perspective view illustrating a state in which the stick 200 and the rotation control element 400 in FIG. 4A are separated from each other.

The rotation control element 400 includes an elongated accommodating member 410 having an internal space which the stick 200 penetrates, and a locking member 420 releasably coupled to at least a part of the head body 101 which adjoins the gap portion 140 of the cleaning head 100.

Figure 4C:
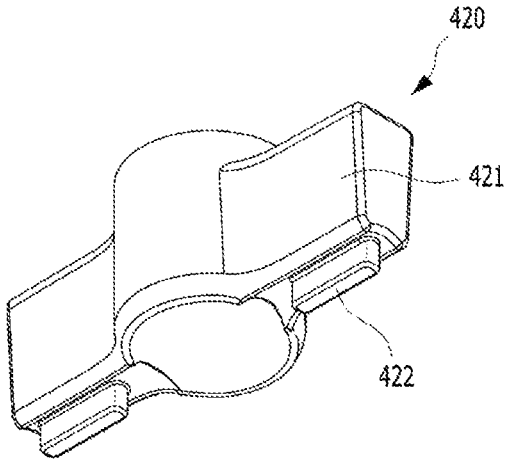
FIG. 4C is an enlarged perspective view of a locking member in FIG. 4B.

The locking member 420 includes a wing portion 421 which extends from one end of the accommodating member 410 outward in a radial direction of the accommodating member 410. The wing portion 421 of the locking member 420 can be inserted into the side locking groove 150 and the angled locking groove 160. The left and right sides of the wing portion 421 are inserted into the first locking groove 151 and the second locking groove 152 of the side locking groove 150, respectively, and inserted into the third locking groove 161 and the fourth locking groove 162 of the angled locking groove 160, respectively. As illustrated in FIG. 4C illustrating an enlarged perspective view of the locking member 420 in FIG. 4B, the wing portion 421 has a shape, the thickness of which decreases toward the lower side in a longitudinal direction of the accommodating member 410, and an outer surface of the wing portion 421 is inclined in the longitudinal direction of the accommodating member 410. The inclined outer surface of the wing portion 421 allows the wing portion 421 to be easily inserted into the side locking groove 150 or the angled locking groove 160.

As illustrated in FIG. 4C, the locking member 420 includes the extension portions 422 which extend from the wing portion 421 in the longitudinal direction of the accommodating member 410. The extension portions 422 each has a shape inclined in such a manner in which a cross-sectional area thereof decreases toward an end thereof. The extension portions 422 can be inserted into the concave portions 311 of the shaft 310 of the rotation coupling element 300.

The accommodating member 410 includes a positioning hole 411 which penetrates the accommodating member 410 in a radial direction of the accommodating member 410. An end portion of the accommodating member 410, which is opposite to the locking member 420, is enclosed by a control holding member 430. The control holding member 430 has a shape that allows the user to easily hold the control holding member 430. In FIG. 4B, the control holding member 430 includes an indented portion 431 indented inward in the radial direction of the accommodating member 410, and the indented portion 431 includes an opening at a position corresponding to the positioning hole 411 so as to expose the positioning hole 411 to the outside.

The stick 200 includes an elongated stick body 210 configured to be accommodated in the accommodating member 410, a stick coupling portion 220 rotatably coupled to the rotation coupling element 300, at least one push button 230 configured to be movable in a radial direction of the stick 200, and a stretchable member 240 configured to be extendible in a longitudinal direction of the stick 200.

The stick body 210 is inserted into the accommodating member 410, and the accommodating member 410 can slide on the stick body 210 along the stick body 210. The stick coupling portion 220 is hinged to the hole 322 of the connector 320 of the rotation coupling element 300.

The push button 230 is configured to be inserted into the positioning hole 411 so as to prevent a relative movement between the rotation control element 400 and the stick 200. The push button 230 can elastically protrude from an outer surface of the stick 200 and can be elastically inserted into the outer surface of the stick 200. An end portion of the push button 230 may have a shape that allows the push button 230 to be easily inserted into the positioning hole 411. In FIG. 4B, the end portion of the push button 230 has a hemispheric shape.

Figure 4D:
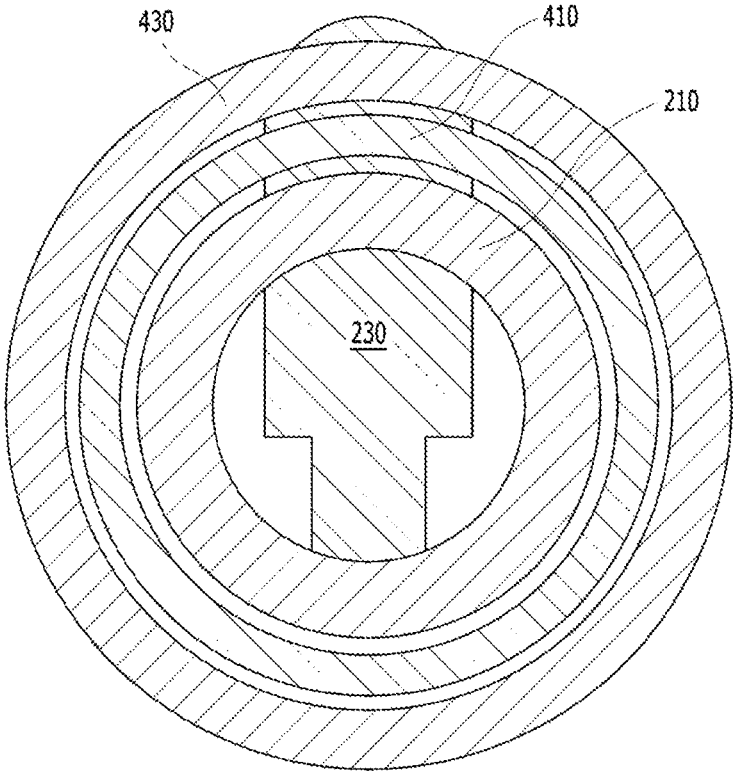
FIG. 4D is a cross-sectional view illustrating a cross section taken along line S-S in FIG. 4A.

FIG. 4D is a cross-sectional view illustrating a cross section taken along line S-S in FIG. 4A. In FIG. 4D, the push button 230 protrudes from the stick body 210, and protrudes to the outside through the positioning hole 411 of the accommodating member 410 and the indented portion 431 of the control holding member 430. An elastic member such as a spring, which elastically biases the push button 230 outward in a radial direction of the stick body 210, is mounted at one end of the push button 230.

When the push button 230 is inserted into the positioning hole 411 as illustrated in FIG. 4D, the rotation control element 400 is prevented from moving along the stick body 210. When it is intended to move the rotation control element 400, the user pushes the push button 230 so as to move the push button 230 into the stick body 210, and then can move the rotation control element 400 with respect to the stick 200.

A plurality of push buttons 230 may be provided, and the respective push buttons 230 may be disposed to correspond to required relative positions between the rotation control element 400 and the stick 200. In FIG. 4B, the stick 200 includes three push buttons 230. In FIG. 4B, the lowermost push button of the push buttons 230 is disposed at a position where the lowermost push button can prevent a relative movement between the stick 200 and the rotation control element 400 in a state in which the locking member 420 is inserted into the angled locking groove 160. In addition, in FIG. 4B, the intermediate push button of the push buttons 230 is disposed at a position where the intermediate push button can prevent a relative movement between the stick 200 and the rotation control element 400 in a state in which the locking member 420 is inserted into the side locking groove 150, and the uppermost push button of the push buttons 230 is disposed at a position where the uppermost push button 230 fixes the rotation control element 400 so that a free movement between the stick 200 and the cleaning head 100 is ensured and hindrance to use of the mop tool 1 is not caused while using the mop tool 1. Unlike FIG. 4B, a plurality of positioning holes 411 may be provided in the accommodating member 410.

The stretchable member 240 includes a main body which can be used as a handle of the mop tool 1, a longitudinal portion (not illustrated) which is connected to the main body and moves in the longitudinal direction of the stick 200, and a locking portion (not illustrated) which restricts or allows the movement of the longitudinal portion. Based on a rotational position of the main body of the stretchable member 240, the movement of the longitudinal portion is restricted or allowed by the locking portion. In addition, the user can check the rotational position of the main body of the stretchable member 240 through a relative position between a mark 241 positioned on the main body and a mark 211 positioned on the stick body 210. FIG. 4B illustrates a state in which the movement of the longitudinal portion of the stretchable member 240 is restricted by the locking portion. When the main body of the stretchable member 240 is rotated in a direction, the longitudinal portion locked by the locking portion is unlocked, and when the main body of the stretchable member 240 is rotated in the opposite direction after the length of the stretchable member 240 is adjusted by moving the longitudinal portion, the movement of the longitudinal portion is restricted. The user can adjust the length of the stick 200 as necessary by using the stretchable member 240.

Figure 5:
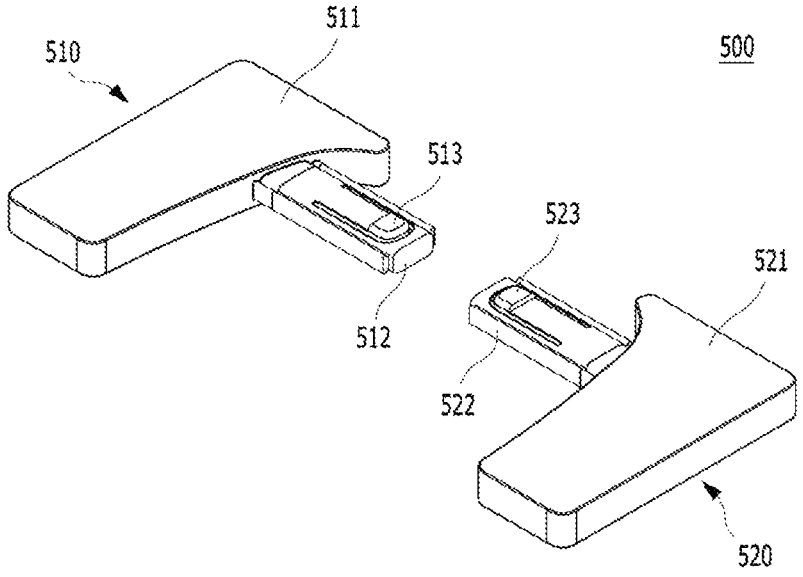
FIG. 5 is a perspective view schematically illustrating an extension element of the mop tool in FIG. 1.

FIG. 5 is a perspective view schematically illustrating the extension element 500 of the mop tool 1 in FIG. 1. The extension element 500 can be coupled to at least one side of the head body 101, and can move toward the head body 101 or away from the head body 101. A bottom area of the mop tool 1 can be adjusted by moving the extension element 500 with respect to the head body 101. Mops having various sizes can be coupled to and used for the mop tool 1 by adjusting the bottom area of the mop tool 1. In addition, when the user places the mop between the floor to be cleaned and the cleaning head 100 and wipes the floor, the user can distribute force, which is applied to the mop by the user, uniformly to the mop by adjusting the bottom area of the mop tool 1 corresponding to the size of the mop.

In FIG. 5, the extension element 500 includes a first extension block 510 and a second extension block 520. The first extension block 510 includes a first block body 511, and a first guide bar 512 which extends outward from the first block body 511, and the first guide bar 512 can be inserted into the head body 101. The first guide bar 512 can be inserted into the first extension passageway 114 of the first head member 110. A cross-sectional shape of the first guide bar 512 is configured to prevent a relative rotation between the head body 101 and the first guide bar 512 inserted into the head body 101. In FIG. 5, a cross section of the first guide bar 512 has a laterally extending shape. The first guide bar 512 includes a rectangular central portion, and a lateral side portions having a trapezoidal shape in cross-section. Grooves are formed between the central portion and the lateral side portions of the first guide bar 512. The first extension passageway 114 of the first head member 110 may have longitudinal protruding portions which are inserted into the grooves, and when the first guide bar 512 is inserted into the first extension passageway 114, the first guide bar 512 can be easily guided to an exact position inside the first extension passageway 114 by engagement between the longitudinal protruding portions of the first extension passageway 114 and the grooves of the first guide bar 512.

The first guide bar 512 includes a first length adjusting member 513 which can elastically move in a thickness direction of the first guide bar 512. In FIG. 5, one end of the first length adjusting member 513 is a fixed end connected to the first guide bar 512, and the other end of the first length adjusting member 513 is a protruding end that protrudes outward from the first length adjusting member 513. For example, the first length adjusting member 513 is configured in the form of a cantilevered beam. The protruding end of the first length adjusting member 513 can elastically move into the first guide bar 512. In FIG. 5, the first length adjusting member 513 is formed integrally with the first guide bar 512, but the first length adjusting member 513 may be formed separately from the first guide bar 512.

When the first guide bar 512 is inserted into the first extension passageway 114, the protruding end of the first length adjusting member 513 is inserted into at least one of the first length adjusting grooves 112. When the protruding end of the first length adjusting member 513 is inserted into the first length adjusting groove 112, the movement between the first extension block 510 and the first head member 110 is prevented. In a case in which the user intends to adjust a distance between the first block body 511 and the first head member 110, the user pushes the protruding end of the first length adjusting member 513 into the first guide bar 512 so as to withdraw the protruding end of the first length adjusting member 513 from the first length adjusting groove 112, thereby enabling a relative movement between the first block body 511 and the first head member 110.

In FIG. 5, the second extension block 520 and the first extension block 510 are configured to be symmetric to each other. A second block body 521, a second guide bar 522, and a second length adjusting member 523 of the second extension block 520 are configured to correspond to the first block body 511, the first guide bar 512, and the first length adjusting member 513 of the first extension block 510, respectively. However, the first extension block 510 and the second extension block 520 may be configured to be asymmetric to each other. For example, the first extension block 510 and the second extension block 520 are asymmetric to each other in terms of at least one of a shape, a color, and a structure of the length adjusting member.

The second guide bar 522 of the second extension block 520 can be inserted into the second extension passageway 124 of the second head member 120. In a case in which both of the first extension block 510 and the second extension block 520 are coupled to the head body 101, a central axis of the first guide bar 512 of the first extension block 510 may be disposed to be coincident with a central axis of the second guide bar 522 of the second extension block 520.

At least one of the first extension block 510 and the second extension block 520 includes a mop coupling element to which the mop is detachably coupled. In addition, the mop coupling element may be provided on at least one of the top surface, the bottom surface, and a side surface of at least one of the extension blocks 510 and 520. Each of the extension blocks 510 and 520 illustrated in FIG. 5 has mop coupling elements at the bottom surfaces thereof. The mop coupling element includes at least one coupler and the mop is held by or attached to the coupler. The coupler includes a hook-and-loop fastener such as Velcro®, a clamp, an adhesive, a groove, a screw, or a combination thereof. The mop coupling element of the extension element 500 may include a plurality of couplers having different coupling structures. The coupler of the extension element 500 may have a coupling structure different from that of the coupler of the cleaning head 100.

At least one of the first extension block 510 and the second extension block 520 may be made of metal, synthetic resin, rubber, wood, fibers, or a combination thereof. For example, at least one of the first extension block 510 and the second extension block 520 includes carbon fibers, aramid fibers, or silicon.

The bottom surface of at least one of the first extension block 510 and the second extension block 520 may be flush with the bottom surface of the head body 101. An embossing protruding portion and/or rubber may be provided on the bottom surface of at least one of the first extension block 510 and the second extension block 520, thereby preventing a slip between the bottom surface and the mop.

In another exemplary embodiment, the extension element 500 is coupled to the cleaning head 100 so as to be rotatable about an axis parallel to the axis L in the direction in which the gap portion 140 of the cleaning head 100 extends. For example, the first extension block 510 and the second extension block 520 may be folded so that the top surfaces of the first extension block 510 and the second extension block 520 face the top surface of the head body 101. The head body 101 may include accommodating grooves which accommodate the folded extension blocks 510 and 520. In this exemplary embodiment, if a part of the mop is placed on the top surface of the head body 101 and the extension element 500 is folded such that the part of the mop is positioned between the extension element 500 and the head body 101, the mop can be fixed to the mop tool 1.

Figure 6A:
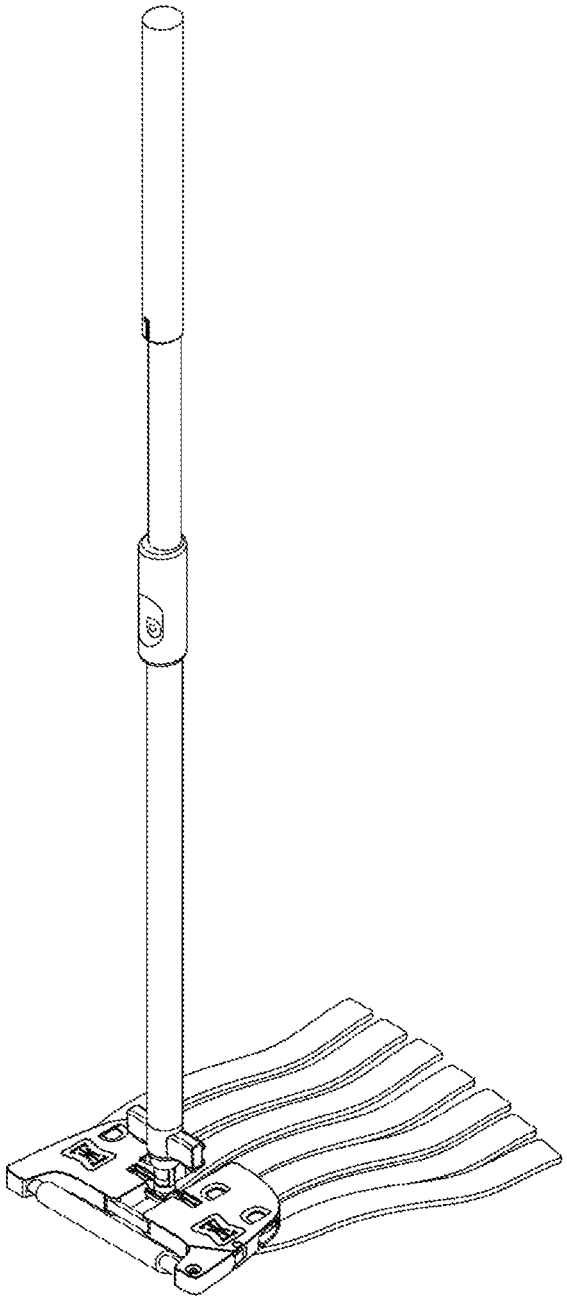
FIG. 6A is a perspective view illustrating a state in which a mop having a plurality of plies is coupled to a hanging bar of the mop tool in FIG. 1.

FIG. 6A is a perspective view illustrating a state in which the mop having a plurality of plies is coupled to the hanging bar 180 of the mop tool 1 in FIG. 1. In FIG. 6A, the extension element 500 is removed from the cleaning head 100. A part of the mop is fastened to the hanging bar 180 of the cleaning head 100, and the user can position the mop between the floor to be cleaned and the cleaning head 100 and then wipe the floor.

Figure 6B:
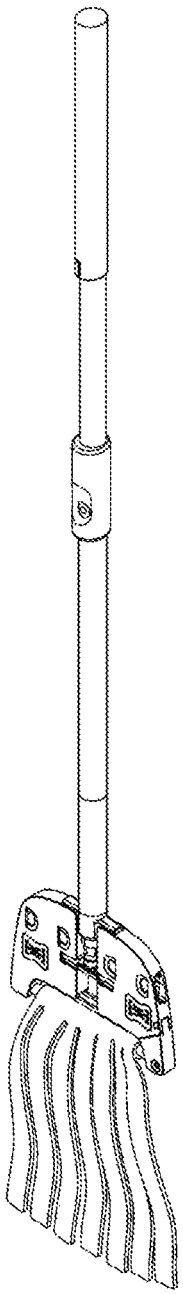
FIG. 6B is a perspective view illustrating a state in which the mop tool in FIG. 6A is lifted up.

FIG. 6B is a perspective view illustrating a state in which the mop tool 1 in FIG. 6A is lifted up from the ground surface. The plies of the mop are hung from the hanging bar 180 toward the ground surface by gravity. The locking member 420 of the mop tool 1 is coupled to the side locking groove 150. The relative rotation between the cleaning head 100 and the stick 200 is prevented by the locking member 420. When the mop tool 1 is in the state illustrated in FIG. 6B, a cross-sectional area of the cleaning head 100 in the longitudinal direction of the stick 200 becomes small, and as a result, the user can easily hold the stick 200 and put the mop fastened to the hanging bar 180 into a container containing water or other liquids for cleaning so as to wash the mop.

Figure 7:
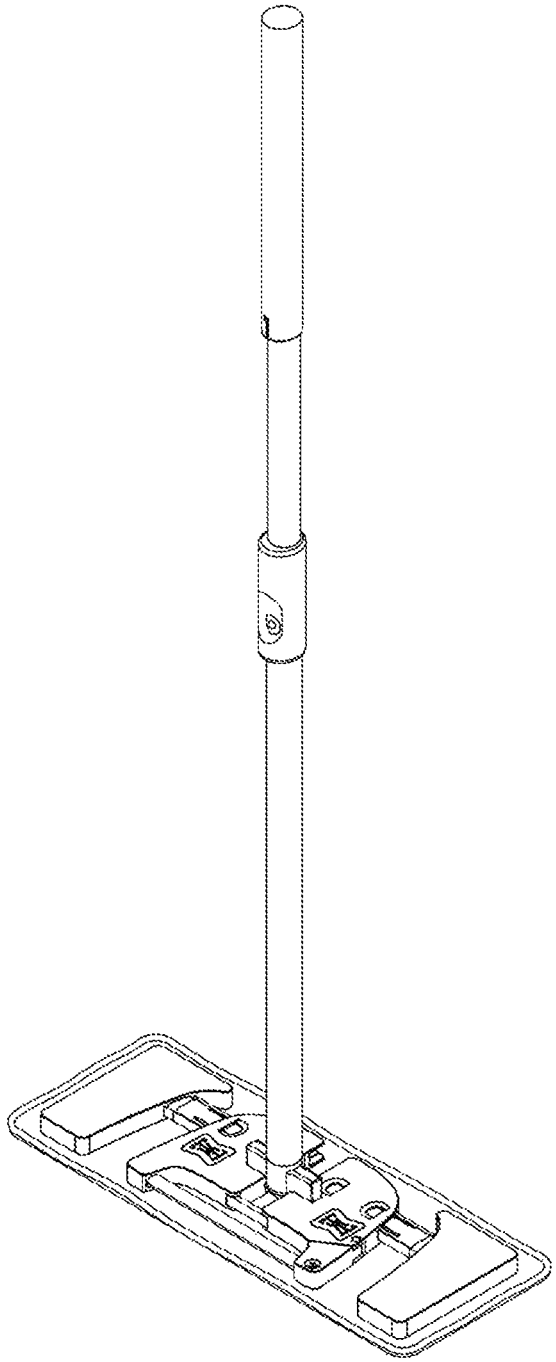
FIG. 7 is a perspective view illustrating a state in which a pad type mop is coupled to a bottom of the cleaning head of the mop tool in FIG. 1.

FIG. 7 is a perspective view illustrating a state in which a pad-type mop is coupled to the bottom of the cleaning head 100 of the mop tool 1 in FIG. 1. The extension element 500 is extracted outward from the cleaning head 100. If the extension element 500 is extracted such that a length of the extension element 500 corresponds to a length of the mop, the extension element 500 and the mop can be fixedly coupled, and force applied to the stick 200 by the user can be uniformly distributed to the mop through the cleaning head 100 and the extension element 500.

As illustrated in FIG. 7, if the locking member 420 is coupled to the angled locking groove 160, the mop can be easily coupled to the cleaning head 100 and/or the extension element 500, and the mop tool 1 can stand up by itself without the movement of the stick 200 when the mop tool 1 is used or stored.

The mop may be coupled to the top surface of the cleaning head 100 illustrated in FIG. 7. In addition, the stick 200 may be rotated through the gap portion 140, and as a result, the top surface of the cleaning head 100 may be directed toward the ground surface to be cleaned. Therefore, both of the top surface and the bottom surface of the cleaning head 100 may be used.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A mop tool comprising:

an elongated stick;

a cleaning head including a head body that has a coupling portion rotatably coupled to one end of the stick, and a gap portion that penetrates the head body in a thickness direction and extends to penetrate from the coupling portion of the head body to one side of the head body; and a rotation control element installed to be movable along the stick, wherein the rotation control element includes a locking member configured to releasably couple with at least a part of the head body which adjoins the gap portion so as to restrict a relative rotation between the cleaning head and the stick, the stick is configured to rotate such that the stick passes through the gap portion, the head body includes a side locking groove extending into the head body from the side of the head body which the gap portion penetrates, and the locking member is releasably inserted into the side locking groove, and the cleaning head includes a hanging bar located at an opposite side of the head body to the side locking groove so as to hang a mop, and the hanging bar is spaced apart from the head body in a direction in which the gap portion extends.

2. The mop tool of claim 1, wherein the coupling portion of the head body includes an angled locking groove into which the locking member is releasably inserted, and when the locking member is inserted into the angled locking groove, the stick forms a predetermined angle with the cleaning head.

3. The mop tool of claim 1, wherein a center of gravity of the cleaning head is spaced apart from the coupling portion of the head body in an opposite direction to the side locking groove on an axis of the gap portion extending along the gap portion.

4. The mop tool of claim 1, wherein the head body includes a first head member and a second head member, and the gap portion is positioned between the first head member and the second head member.

5. The mop tool of claim 4, wherein one end of the hanging bar is coupled to the first head member, and another end of the hanging bar is releasably coupled to a bar fixing member rotatably coupled to the second head member.

6. The mop tool of claim 5, wherein the bar fixing member includes a hollow portion configured to receive the other end of the hanging bar, and a control rod extending transversally to the hollow portion and being capable of engaging with the other end of the hanging bar.

7. The mop tool of claim 1, wherein the rotation control element further includes an elongated accommodating member having an internal space which the stick penetrates, and the locking member includes a wing portion extending from one end of the accommodating member in a radial direction of the accommodating member.

8. The mop tool of claim 7, wherein the accommodating member includes a positioning hole penetrating the accommodating member in the radial direction of the accommodating member, and the stick includes at least one push button configured to move in a radial direction of the stick to be inserted into the positioning hole so as to prevent a relative movement between the rotation control element and the stick.

9. The mop tool of claim 8, wherein an elastic member is mounted at one end of the push button so as to cause the push button to elastically protrude from or be inserted into an outer surface of the stick.

10. The mop tool of claim 1, further comprising:

a rotation coupling element configured to couple the stick to the coupling portion of the head body, wherein the rotation coupling element includes a shaft coupled to the coupling portion of the head body and having a first axis, and a connector connecting the stick to the shaft, the connector includes a curvature portion coupled to the shaft so as to be rotatable about the first axis, a rotating portion coupled to the curvature portion so as to be rotatable about a second axis perpendicular to the first axis, and a hole having a third axis perpendicular to both of the first axis and the second axis and penetrating the rotating portion, and the one end of the stick is coupled to the hole so as to rotate about the third axis.

11. The mop tool of claim 1, further comprising:

an extension element coupled to at least one side of the head body, wherein the extension element is configured to move toward or away from the head body.

12. The mop tool of claim 11, wherein the extension element includes at least one extension block, the extension block includes a block body and a guide bar extending outward from the block body, and the guide bar is configured to be inserted into the head body.

13. The mop tool of claim 12, wherein the head body includes an extension passageway into which the guide bar is inserted, and a cross-sectional shape of the guide bar is configured to prevent a relative rotation between the head body and the guide bar inserted into the head body.

14. The mop tool of claim 13, wherein the guide bar includes a length adjusting member elastically movable in a thickness direction of the guide bar, and the length adjusting member is configured to be inserted into a plurality of length adjusting grooves provided in the head body.

15. The mop tool of claim 11, wherein the cleaning head, the extension element, or the cleaning head and the extension element includes a mop coupling element, and the mop is detachably coupled to the mop coupling element.

16. The mop tool of claim 15, wherein the mop coupling element includes a plurality of couplers configured to hold the mop and the couplers have different coupling structures from each other.

17. The mop tool of claim 1, wherein at least a part of the head body is made of metal, synthetic resin, rubber, fibers, or a combination thereof.

* * * * *